United States Patent [19]

Dreibelbis

[11] 4,112,810

[45] Sep. 12, 1978

[54] TUBE SLOTTER

[75] Inventor: Logan L. Dreibelbis, Cincinnati, Ohio

[73] Assignee: Advanced Drainage Systems, Inc., Columbus, Ohio

[21] Appl. No.: 734,197

[22] Filed: Oct. 20, 1976

[51] Int. Cl.[2] ..... B26D 3/16

[52] U.S. Cl. ..... 83/490; 83/54

[58] Field of Search ..... 83/490, 54, 39, 210, 83/282, 326, 329

[56] References Cited

U.S. PATENT DOCUMENTS

| | | | |
|---|---|---|---|
| 2,572,137 | 10/1951 | Grieder | 83/210 |
| 3,824,886 | 7/1974 | Hegler | 83/329 |
| 3,901,113 | 8/1975 | Oltmanns et al. | 83/326 |

*Primary Examiner*—Donald R. Schran

*Attorney, Agent, or Firm*—Connolly and Hutz

[57] ABSTRACT

Tube slotting machine for cutting series of transverse slotted openings in flexible corrugated tubing comprises main framework with tube supporting and conveying structure connected thereto for guiding tubing through machine. Cutting structure is adapted to engage tubing as it travels through machine and to cut transverse slotted openings therein. Cutting structure includes plurality of primary cutter blades, and equal number of spaced apart secondary blade pairs are arranged with one primary blade located between each pair. Each secondary blade has curved portion that complements curvature of tubing. Secondary blades are positioned next to exterior of tubing as it moves through machine along its path of travel, and primary cutter blade is shifted across its associated secondary blade pair so that primary blade penetrates tubing and sweeps across secondary blade pair to thereby cut slivered portion from tubing to provide transverse slotted opening therein.

22 Claims, 28 Drawing Figures

202
222
220
224
30°
30°

202
54°
30°

202
78°
30°

202
12°
30°

202
36°
30°

202
60°
30°

120
216
156
208
232
202
158
230
224
210
60°

Fig. 20.
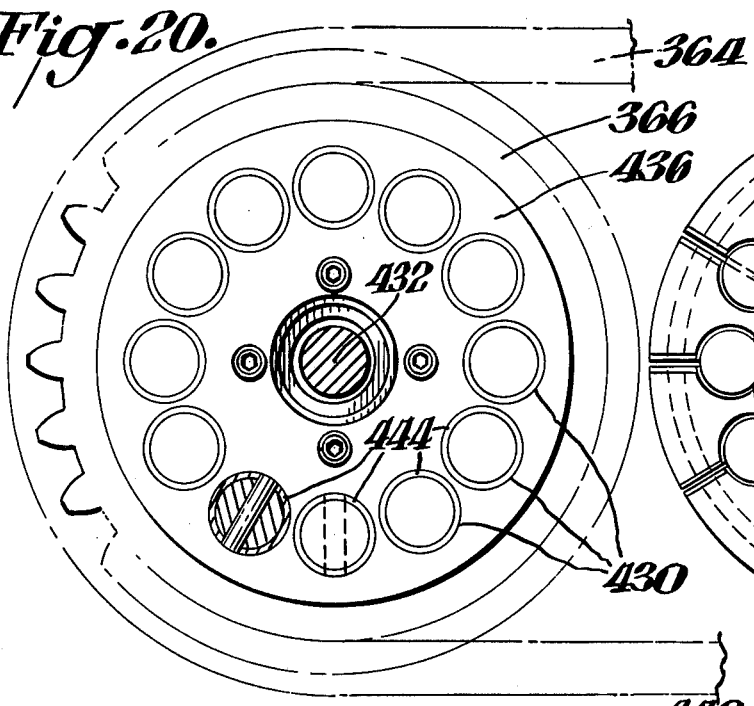
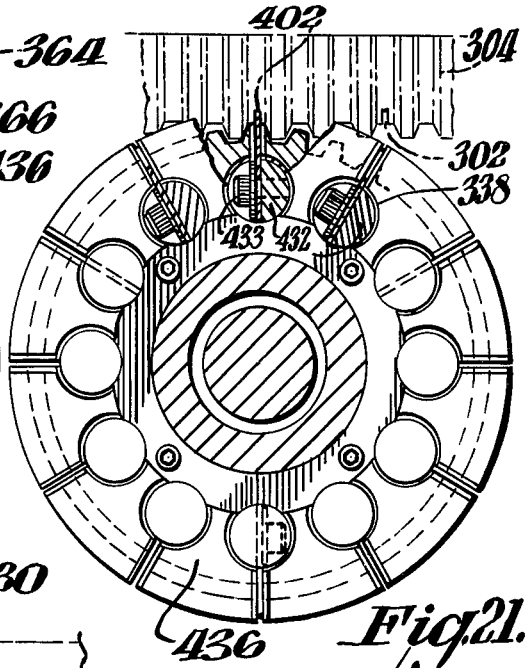
Fig. 21.
Fig. 19.
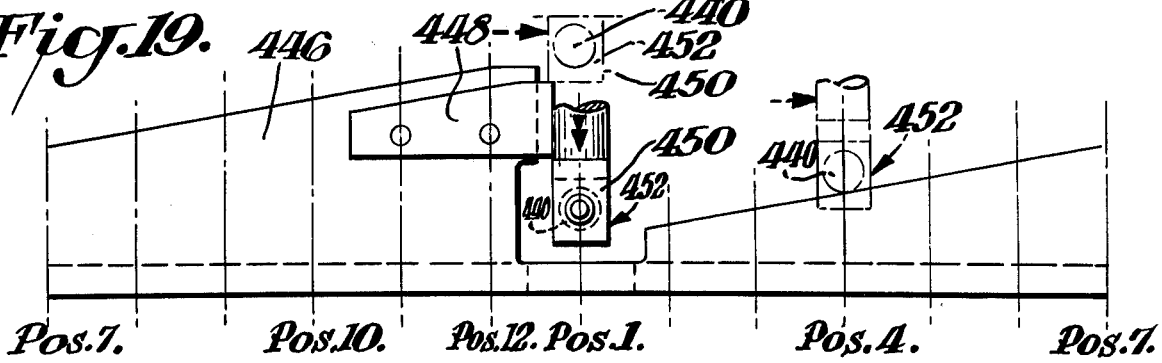
Fig. 17.
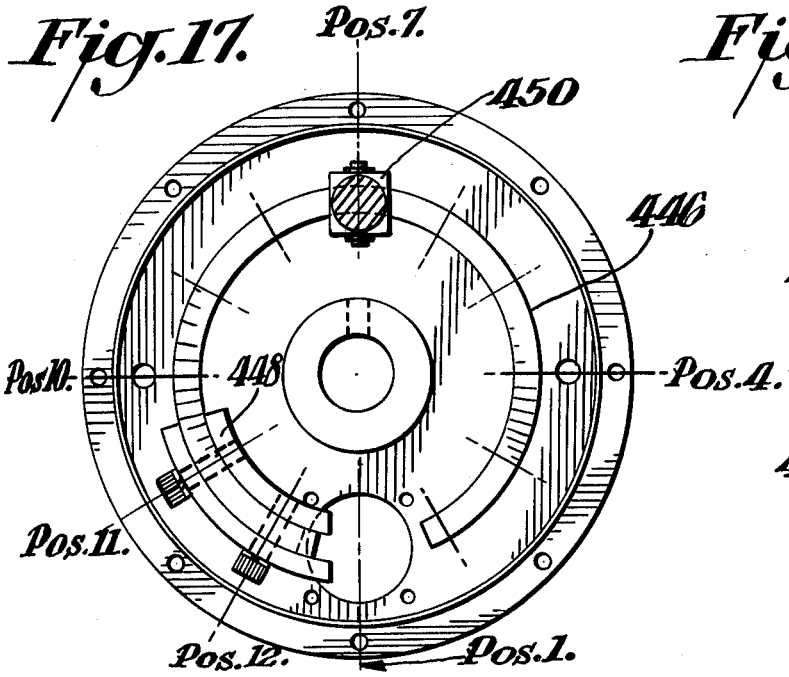
Fig. 18.
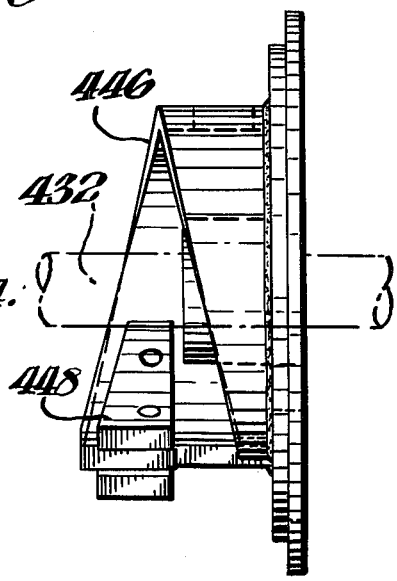

TUBE SLOTTER

BACKGROUND OF THE INVENTION

The present invention relates to a tube slotting machine, and more particularly to a machine that provides tubing with clean slotted openings free of roughened edges.

In the past, land improvement through proper drainage was an expensive and time consuming operation. The red clay tile commonly used for this purpose required the piecing together of relatively short lengths to construct the desired subsurface drainage system. These systems were vulnerable to misalignment due to the large number of lengths required to construct them, and extreme care was required when the system of tiles was covered with earth in order to avoid breakage of the tile material. For the most part, corrugated drainage tubing manufactured from polyethylene and the like has now replaced the heretofore drainage systems of tile pieces.

The tubing used for subsurface drainage systems is corrugated for flexibility and strength. An arrangement of slotted openings in the tubing allows excess water from the surrounding earth to enter the tubing and thereby be conveyed away by the drainage network. Usually, a minimum of one square inch of slotted open area is required from each one foot length of tubing.

Generally, these slotted openings are located in the center of the corrugation valley with not less than three rows around the circumference of the tube. Usually the slotted openings are 1/16 inch wide, and range in lengths from 1 to 1½ inches depending on the diameter of the tube. It is highly desirable that the openings be relatively clean and well formed and located in the corrugation valleys.

At present, the slotted openings in corrugated tubing are generally produced by cutting machines using rotary saw blades. These blades are mounted on arbors in any number ranging from a single blade to as many as eighteen or more blades. In operation, the blades rotating at significantly high speed are brought into contact with the tubing in a radial direction so that the blades register with the corrugation valleys. Utilization of rotary saw blades has certain drawbacks since these blades rapidly become dull which results in the slotted openings having badly roughened peripheral portions. Even when the blades are sharp, a certain amount of peripheral roughness exists. These roughened portions trap and collect foreign material which decreases the efficiency of the drainage system.

Another problem encountered by using saw blades involves registry of the blades with the valley center lines. Also, an accumulation of dust results from the sawing operation, and the procedure is quite noisy and very dirty.

Other methods of producing slotted openings or drainage areas in the exterior of corrugated tubing have been utilized such as drilling, punching, and cutting the tops off of indentations or protrusions molded in the tube, for example. However, these procedures have the same drawbacks mentioned above. Also power consumption in the operation of drilling and punching equipment is high.

SUMMARY OF THE INVENTION

Accordingly, it is an object of the present invention to provide a simple and trouble-free tube slotting machine that provides corrugated drainage tubing with transverse slotted openings.

Another object of the present invention is a tube slotting machine that cuts slotted openings in tubings where the openings are characterized by their clean and smooth peripheral boundaries.

Another object of the present invention is to cut slotted openings which are free of roughened portions.

In accordance with the present invention, a tube slotting machine for cutting a series of slotted openings in flexible corrugated tubing comprises a main framework with tube supporting and conveying means connected thereto for guiding the tubing through the machine. Cutting structure is adapted to engage the tubing as it travels through the machine and to cut transverse slotted openings therein. The cutting structure includes a plurality of primary cutter blades and an equal number of spaced apart secondary blade pairs arranged with a primary blade located between each of the pairs. The secondary blades have curved portions that complement the curvature of the tubing, and these curved secondary blade pairs are positioned next to the exterior of the tubing as it moves through the machine along its path of travel. The primary blades are shifted across their associated secondary blade pairs during the cutting operation so that in turn each primary blade penetrates the tubing and sweeps across its associated secondary blade pair to cut a slivered portion from the tubing to provide a transverse slotted opening therein.

Each primary cutter blade has a cutting structure and a return stroke. In the first embodiment of the invention the structure for shifting the primary cutter blades is connected to rotate those blades through their cutting and return strokes. In the second embodiment of the invention the structure for shifting the primary cutter blades is connected to reciprocate those blades through their cutting and return strokes.

The cutting structure of the tube slotting machine of the first embodiment may include a carriage with fixtures connecting the primary blades and the secondary blade pairs thereto. The carriage reciprocates over a portion of the path of tube travel at a speed equal to the speed of travel of the tubing during the cutting thereof. Preferably, an air cylinder connected between the framework of the machine and the carriage imparts the reciprocal movement. Also, a second air cylinder may be provided between the framework and the carriage to assist in accelerating the carriage at the start of its movement in the direction of travel of the tubing. The carriage has wheels on the underside thereof arranged to ride on tracks secured to the framework of the machine.

The cutting structure supported by the carriage includes three cutter subassemblies arranged around the tubing and approximately 120° apart. Each cutter subassembly includes a plurality of primary cutter blades and an equal number of secondary blade pairs. A chain and sprocket drive interconnects the primary cutter blades of each cutter subassembly. Rotation of the tubing during the cutting operation is lessened and/or eliminated by rotating the primary cutter blades of two of the cutter subassemblies in the same direction while rotating the primary cutter blades of the third subassembly in the opposite direction.

The structure for supporting and conveying the tubing through the machine of either embodiment may include a pair of first pulling wheels journaled to the framework at the entrance end of the machine together with a pair of secondary pulling wheels journaled to the framework at the exit end of the machine. Each of the pulling wheels has peripheral teeth constructed to mesh with the corrugations in the tubing. A motivator is provided for rotating the pulling wheels to move the tubing through the machine.

In the first embodiment of the invention the pulling wheels of the first pair are disposed one above the other and the pulling wheels of the second pair are also so disposed. In the second embodiment, the pulling wheels of the first pair are offset about 45° to one side of the path of tube travel, and the pulling wheels of the second pair are also offset about 45° but to the other side of the path of tube travel. In the second embodiment of the invention, the pulling wheels of each pair are constructed for movement toward and away from one another to thereby vary the distance between the wheels to accommodate tubing of different diameter.

In the second embodiment of the invention the primary cutter blades are reciprocally mounted on each of the pulling wheels and the secondary cutter blade pairs are fixed on the exterior of the wheels. The primary blades are reciprocally mounted adjacent the path of tube travel for transverse movement relative thereto.

Also, in the second embodiment of the invention the means for shifting the primary cutter blades across their associated secondary blade pairs includes biasing structure. A cam track is provided for loading the primary cutter blades against the biasing structure prior to the cutting stroke of the primary blades.

BRIEF DESCRIPTION OF THE DRAWING

Novel features and advantages of the present invention in addition to those mentioned above will become apparent to those skilled in the art from a reading of the following detailed description in conjunction with the accompanying drawing wherein similar reference characters refer to similar parts and in which.

Figure 14:
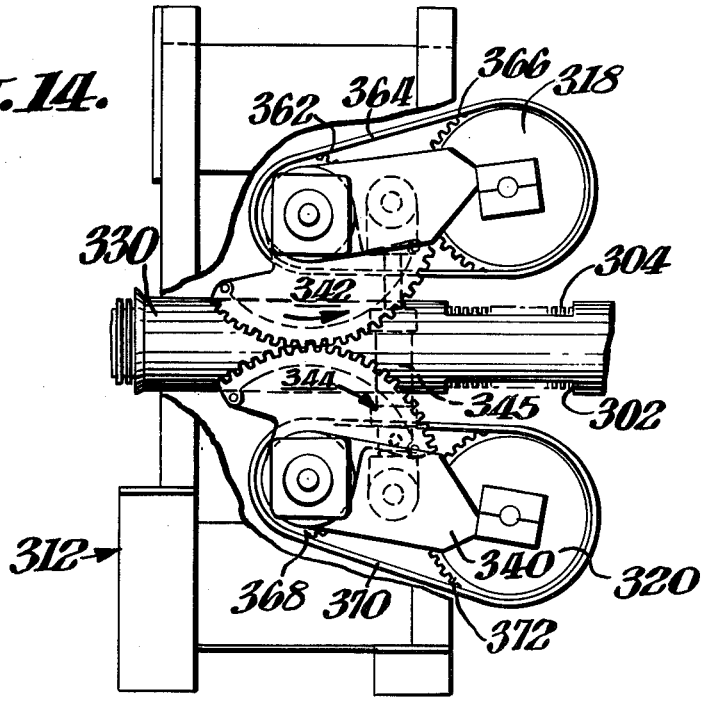
Figure 5:
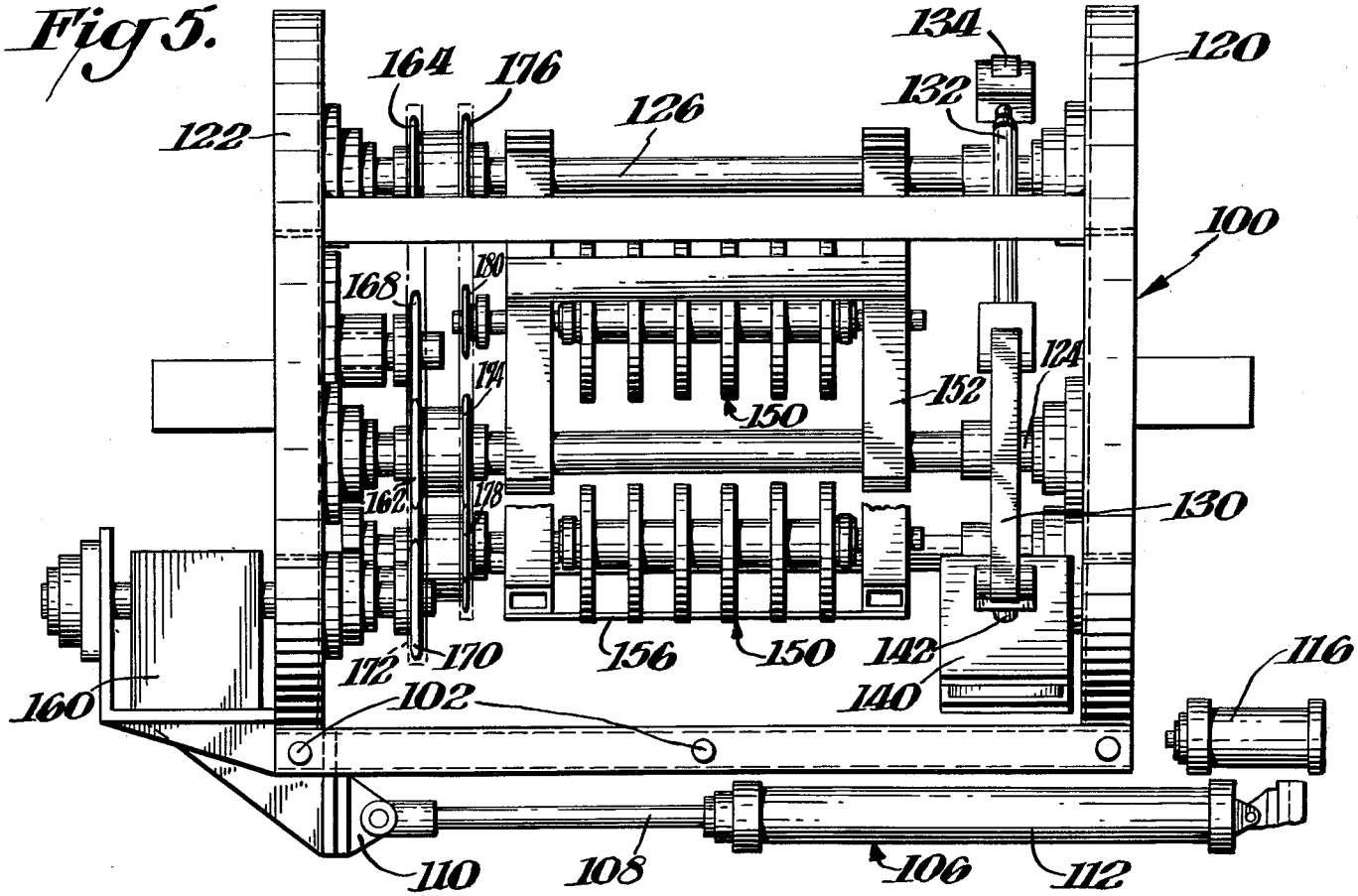
FIG. 5 is a front elevational view of the cutter carriage of the tube slotting machine shown in FIG. 1.
Figure 6:
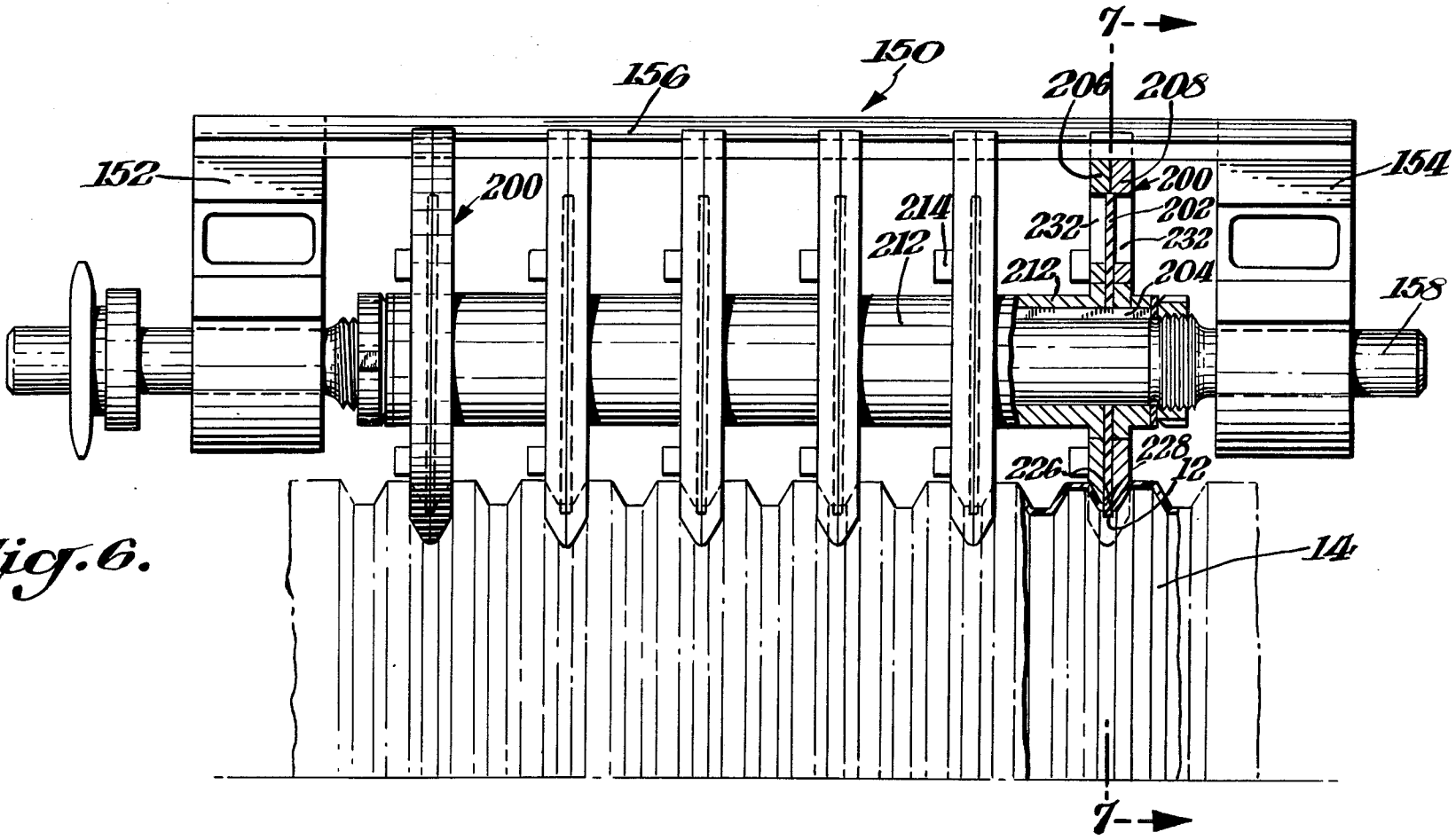
FIG. 6 is an elevational view of one of the cutter subassemblies of the carriage with portions thereof broken away to show detail and the relationship of the subassembly with the tubing being processed.
Figures 7, 7A, 7B, 7C, 7D, 7E, 7F:
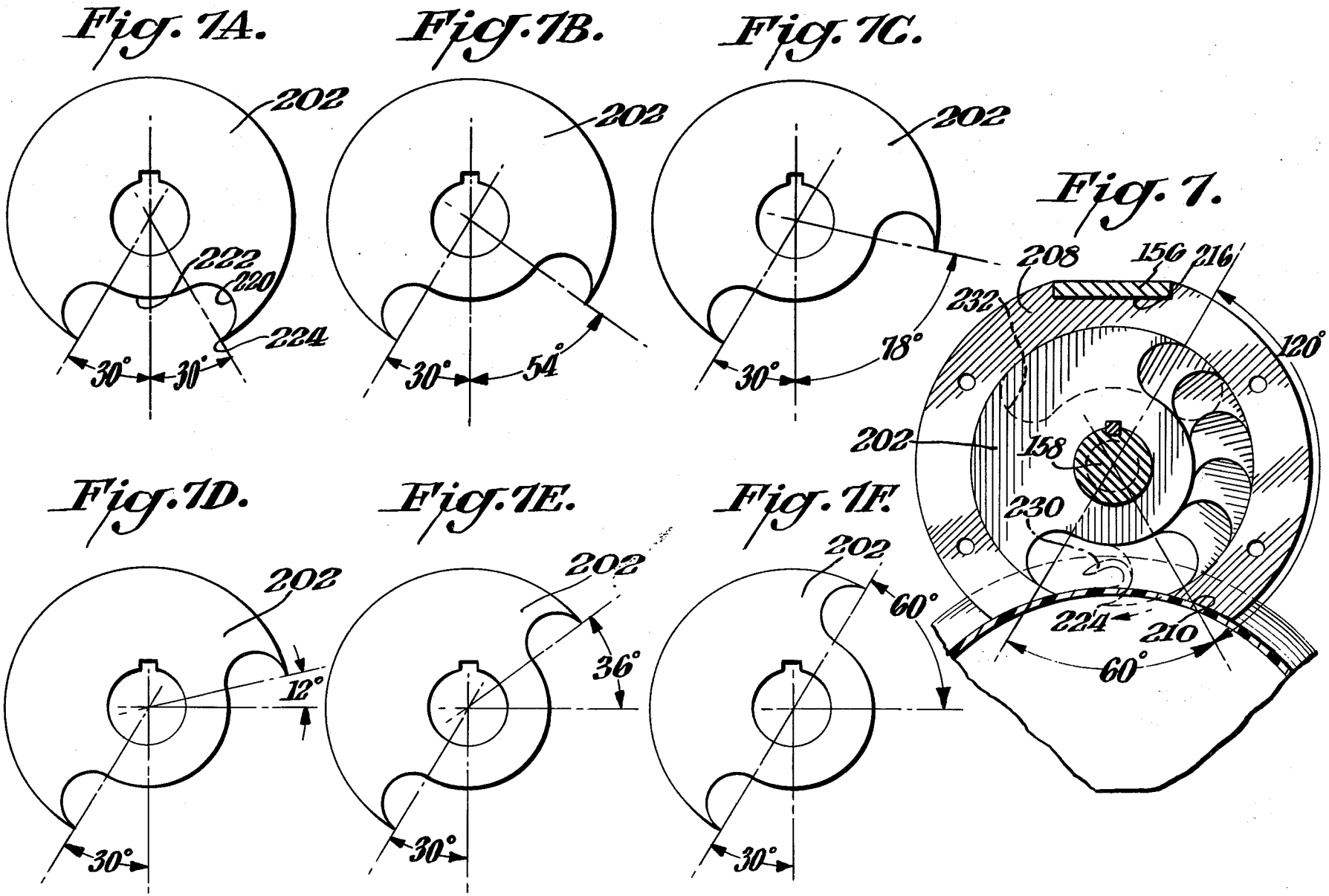
FIG. 7 is a sectional view taken along line 7—7 of FIG. 6.
Figure 8:
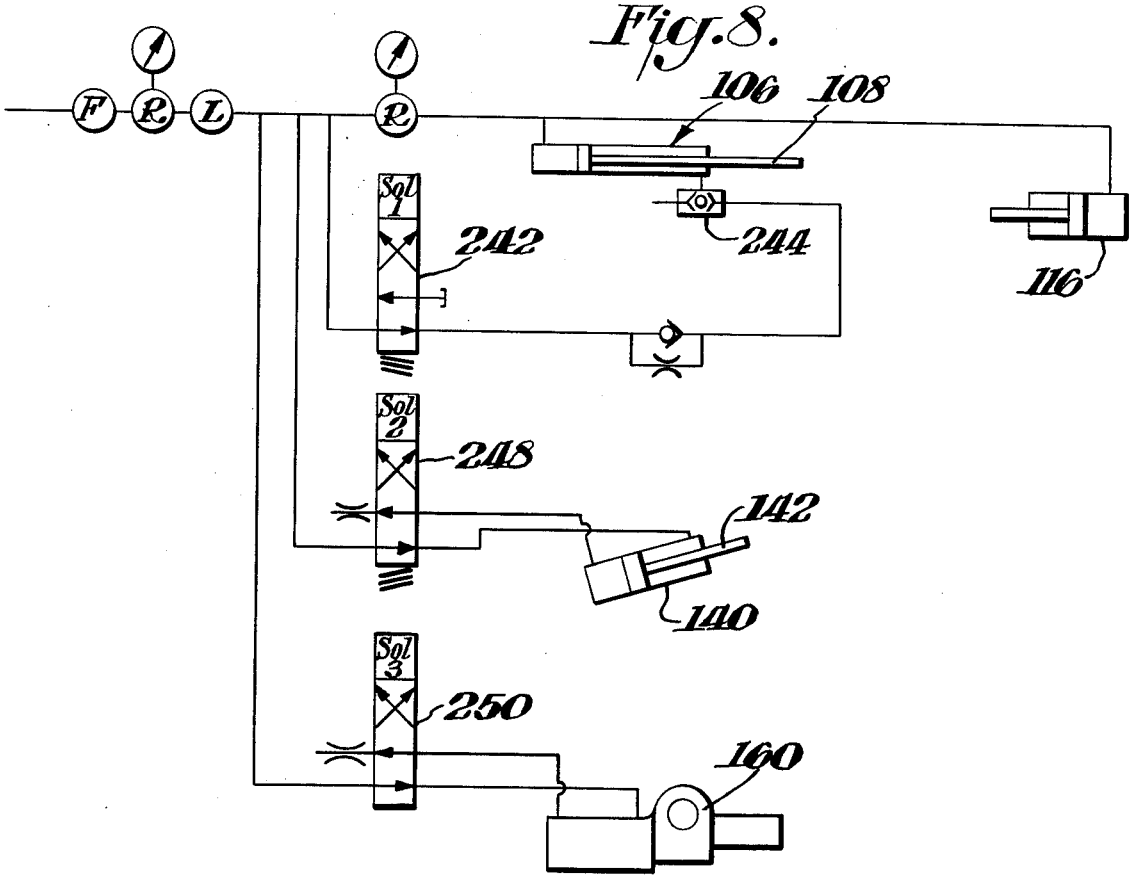
Figure 9:
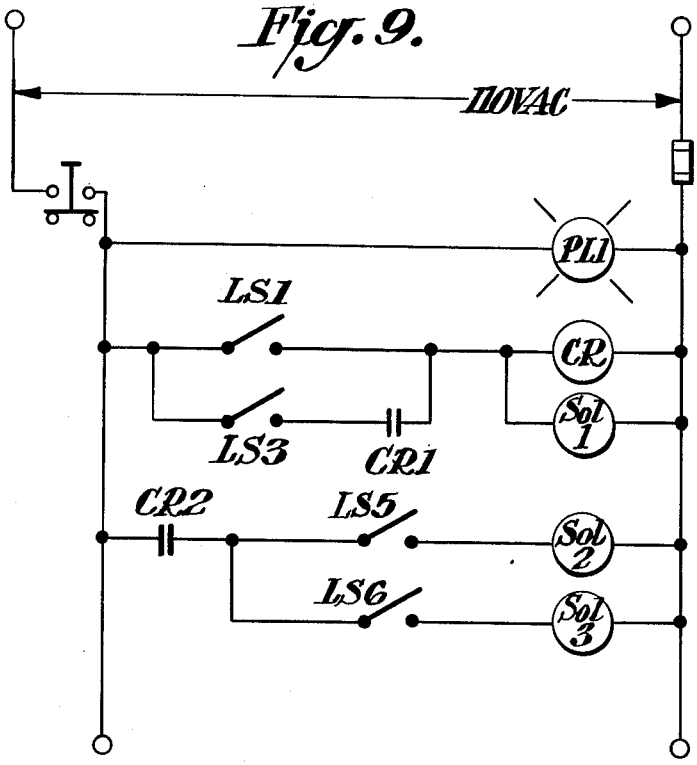
Figure 10:
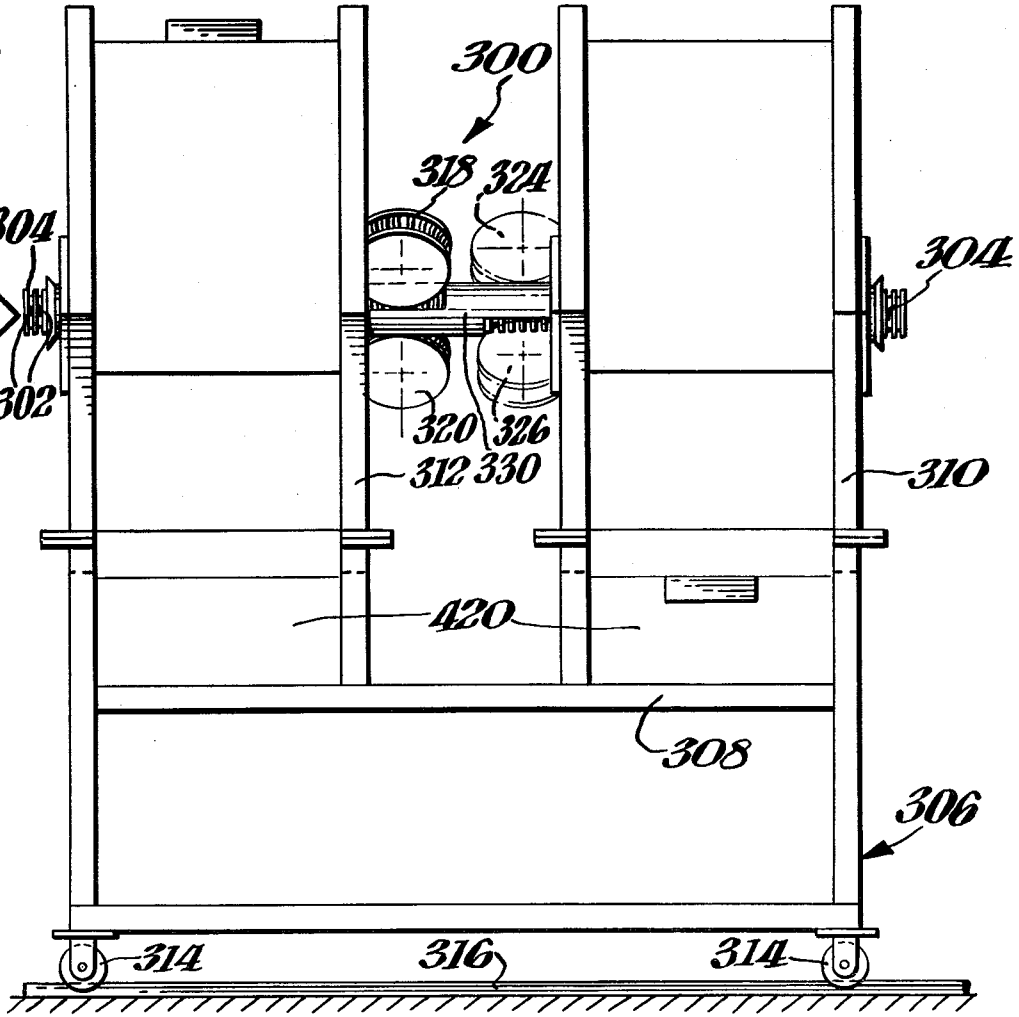
Figure 11:
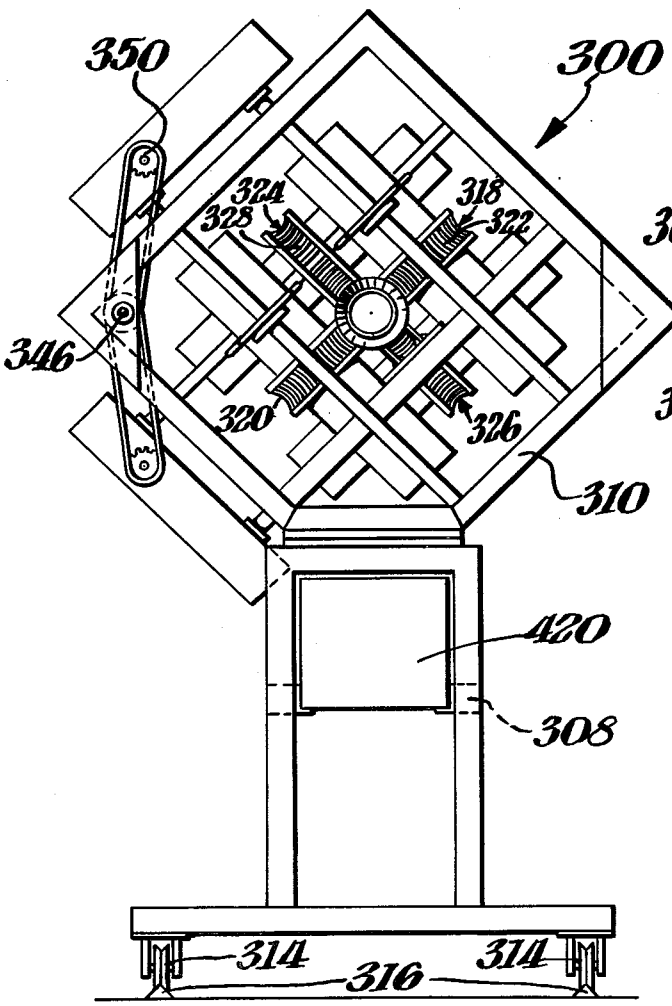
Figure 13:
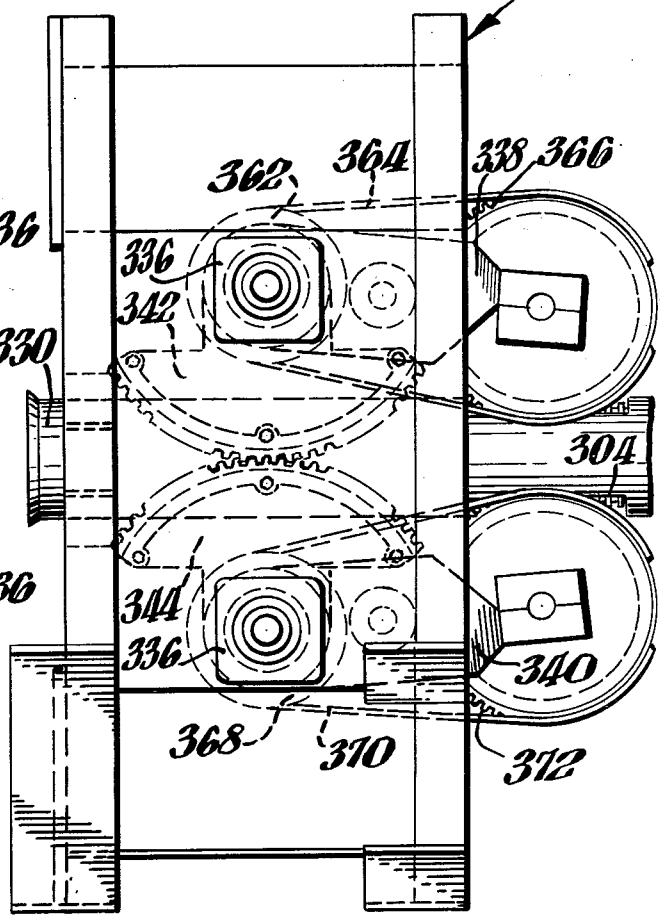
Figure 12:
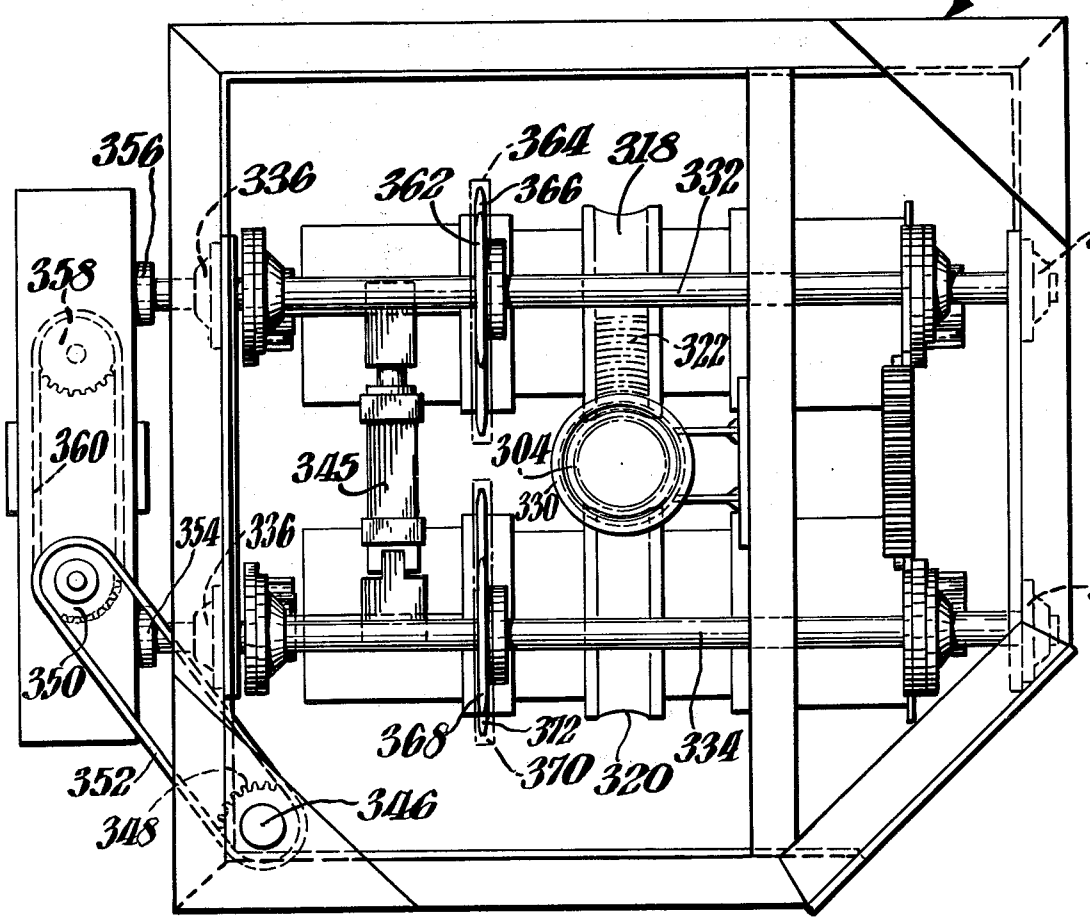
Figures 15, 16:
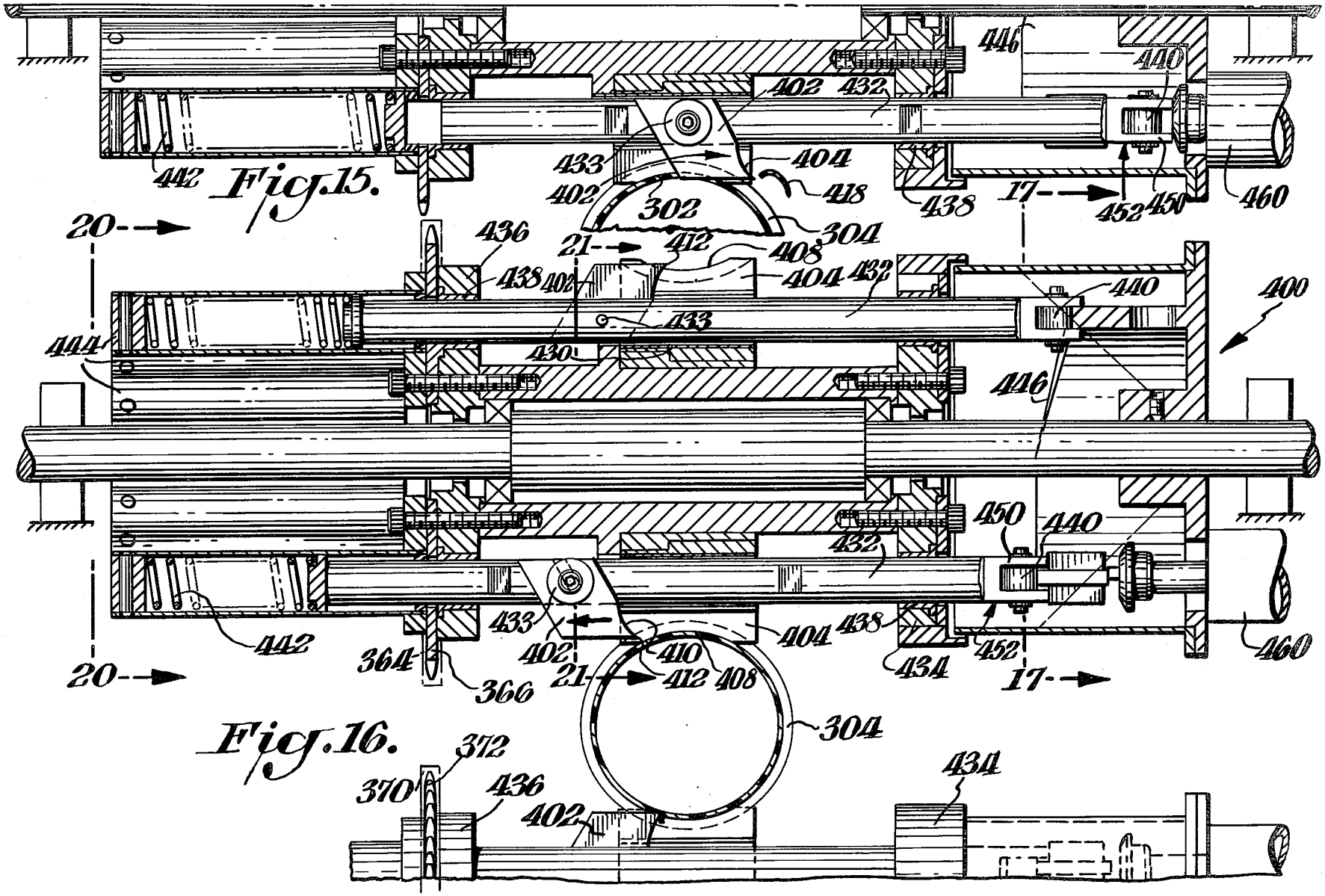

FIG. *7a–7f* illustrate each of the moving cutting blades of the subassembly shown in FIG. 6;

FIG. 8 is a diagrammatic view of the pneumatic control for the tube slotting machine illustrated in FIGS. 1–7;

FIG. 9 is a diagrammatic view of the electrical control for the tube slotting machine shown in FIGS. 1–7;

FIG. 10 is a side elevational view illustrating another embodiment of a tube slotting machine, according to the present invention;

FIG. 11 is an end elevational view of the tube slotting machine shown in FIG. 10;

FIG. 12 is an end elevational view of one of a pair of cutter subassemblies of the tube slotting machine shown in FIGS. 10 and 11;

FIG. 13 is a side elevational view of the cutter subassemblies shown in FIG. 12;

FIG. 14 is a view similar to FIG. 13 with the pulling wheels of the cutter subassemblies shown in their open position;

FIG. 15 is a fragmental sectional view of a portion of one of the cutter subassemblies of the tube slotting machine shown in FIGS. 10–14, illustrating the moving cutter blade during its cutting stroke;

FIG. 16 is a fragmental sectional view of a pair of cutter subassemblies of the tube slotting machine shown in FIGS. 10–14, illustrating the moving cutter blades prior to the cutting stroke;

FIG. 17 is a sectional view taken along line 17—17 of FIG. 16 illustrating a cam mechanism for controlling the reciprocal movement of the moving cutter blades of the tube slotting machine illustrated in FIGS. 10–16;

FIG. 18 is a side elevational view of the cam mechanism shown in FIG. 17;

FIG. 19 is a development of the cam mechanism shown in FIGS. 17 and 18;

FIG. 20 is a sectional view taken along line 20—20 of FIG. 16, showing the end of one of the cutter subassemblies;

FIG. 21 is a sectional view taken along line 21—21 of FIG. 16; and

Figure 22:
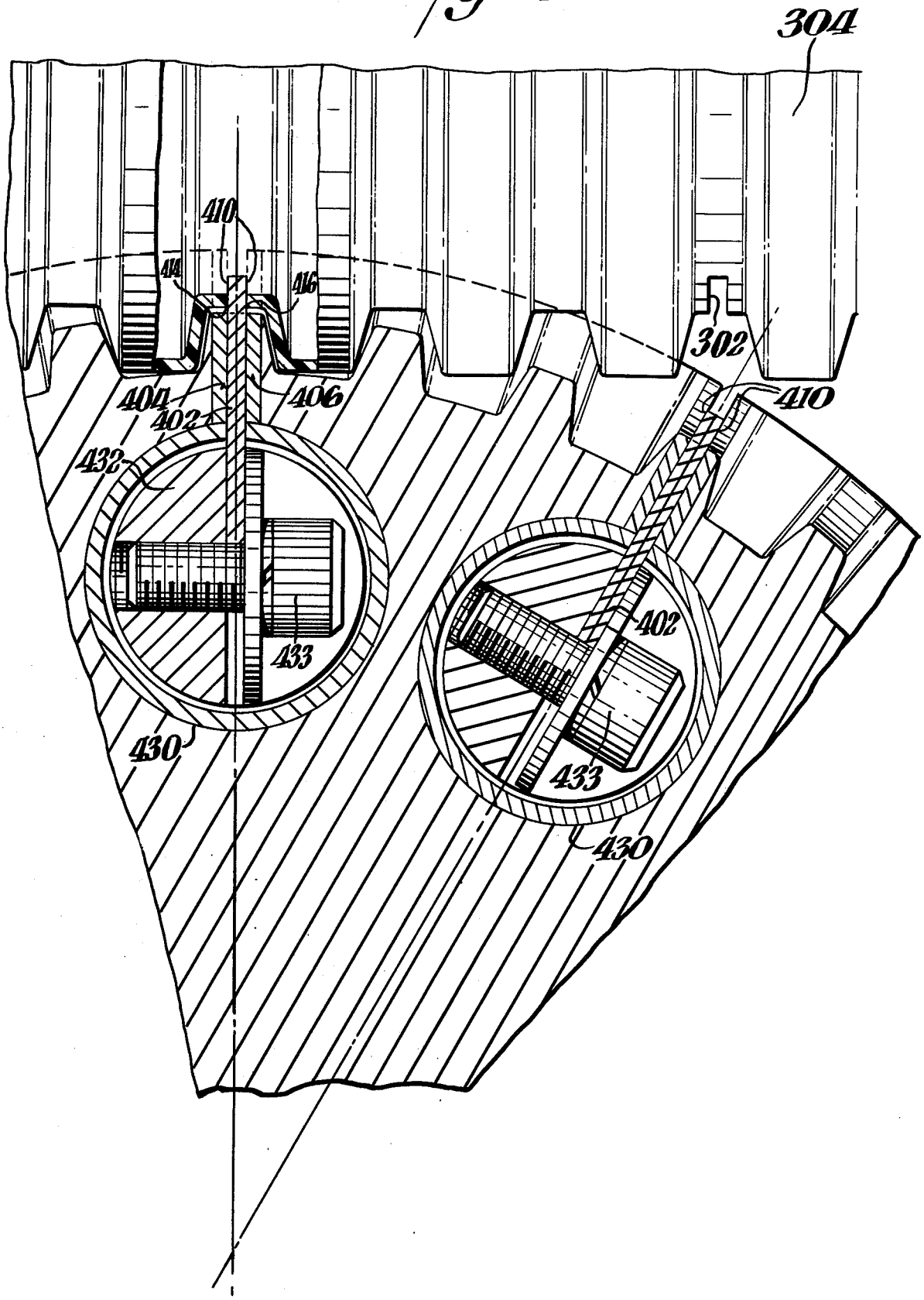

FIG. 22 is an enlarged view illustrating the cutting action between the tubing being processed and one of the cutter subassemblies of the tube slotting machine illustrated in FIGS. 10–21.

DETAILED DESCRIPTION OF THE INVENTION

FIGS. 1–9 illustrate a tube slotting machine 10 for cutting a series of transverse slotted openings 12 in flexible corrugated tubing 14. In the manufacture of corrugated drainage tubing, smooth-walled tubing of thermoplastic material is initially formed by an extrusion process and thereafter the newly formed tube is drawn into corrugating molds. A pressure differential between the interior and exterior of the tube with the higher pressure on the inside forces the soft thermoplastic material against the molds to thereby form the corrugations in the tube. Cooling of the corrugated tube then takes place, and the tube slotting machine 10 is located downstream from the cooling station.

In the embodiment of the invention illustrated in FIGS. 1–9, each of a plurality of primary cutter blades sweeps across its associated secondary blade pair to cut a slivered portion from the tubing 14 to thereby provide the transverse slotted openings 12. The secondary blade pairs are positioned next to the exterior of the tubing 14 and the primary cutter blades rotate so that each primary blade penetrates the tubing and sweeps across its associated secondary blade pair to cut the slotted openings 12.

Each primary cutter blade has two sharp edges spaced apart by the thickness of the blade while each secondary blade has a single sharp edge. As explained more fully below, during the cutting operation, the two sharp edges of a primary cutter blade sweep across the sharp edges of the secondary blade pair with the tubing 14 therebetween. The shearing action between the sharp edges of these blades cuts a clean sliver from the tubing to thereby produce a slotted opening 12 free of roughened edges.

As shown best in FIGS. 1–4, the tube slotting machine 10 comprises a main framework 16 which supports the various components of the overall machine. Generally, the framework 16 includes a bed portion 18 with upright portions 20,22 at the ends thereof. Upright portion 20 forms the entrance end of the machine while portion 22 forms the exit end of the machine. Wheels 24 are journaled to the framework at the lower end of the upright portions and these wheels cooperate with rails 26 on the ground for positioning the machine 10 at various locations along the path of the rails. As shown in the drawing, the composite of the framework 16 includes other structural elements that impart the desired structural strength to the framework.

The machine 10 has tube supporting and conveying structure for guiding the tubing 14 through the machine. This structure includes a first pair of upper and lower pulling wheels 28,30 journaled to the upright portion 20 of the framework 16 at the entrance end of the machine. Journal blocks 32 are utilized to anchor the pulling wheels 28,30 to the framework. The exterior of each of the pulling wheels includes teeth 34 constructed and arranged to mesh with the corrugations in the tubing 14. Corrugate tubing is delivered between the nip of the pulling wheels 28,30, and rotation thereof causes the tubing to move into the machine via the meshing engagement of the pulling wheel teeth 34 and the tube corrugations.

The tube supporting and conveying structure also includes a second pair of upper and lower pulling wheels 36,38 journaled to the upright portion 22 of the framework 16 at the exit end of the machine. Journal blocks 40 function to rotatably secure the pulling wheels to the framework. Here again, the exterior surface of each pulling wheel 36,38 includes teeth 42 that meshingly engage the corrugated tube to pull it away from the machine 10 when the wheels rotate. Hence, the pulling wheels 28,30 at the entrance end pull the tubing 14 into the machine while pulling wheels 36,38 at the exit end pull the tubing away from the machine. Tube guides 43 are also provided.

The tube slotting machine 10 is driven by a drive line consisting of telescoping square shafts 45, tubes, and universal joints powered by the corrugator motor (not shown) through suitable reduction gearing so that the pulling wheels run at the same tube speed as the corrugator. The motor 44 connected to the differential is a control motor which is normally at a standstill condition, but may be energized to run in either direction for short periods of time.

One direction of rotation of the motor causes the exit pulling wheels to rotate faster than the inlet pair of pulling wheels. This causes the corrugated tubing caught between inlet pulling and exit pulling wheels to stretch and increase the linear pitch of the corrugations. The opposite direction of rotation causes the wheels at the exit end to rotate slower than wheels at the inlet end. This causes the tubing captured between the two sets of wheels to compress, thereby reducing the linear pitch of the corrugations. When the adjustment has been made so that the corrugation pitch of the tube equals the pitch of the cutting blades on the slotter mandrels the adjustment is complete.

The motor 44 is connected to a differential 46, and a shaft 48 and gear box 50 connect the differential 46 to a first entrance end shaft 52 journaled to the framework 16. Suitable connectors 54,56,58 are appropriately provided. Shaft 52 carries an end sprocket pair 60 connected by chain 62 to a sprocket 64 secured to the shaft 66 of the lower pulling wheel 30 of the entrance end pair. Power is transmitted from the lower wheel 30 to the upper wheel 28 by a gear 68 fixed to the pulling wheel 30 that meshes with a similar gear 70 fixed to the upper pulling wheel 28. Shaft 52 also carries sprocket 72 which is connected by chain 74 to sprocket 76. Sprocket 76 is connected to shaft 78 journaled to the framework 16 of the machine. Rotation of shaft 78 functions in the machine control sequence.

The second output from the differential 46 is connected to a first exit end shaft 80 via a drive shaft 82 and gear box 84. Suitable connectors 86,88 are provided in the drive shaft 82 and the shaft 80, respectively. The first exit end shaft 80 carries a sprocket 90 and its complementary sprocket 92 is fixed to the shaft 94 for the lower pulling wheel 38 of the exit end pair. A chain 96 interconnects the sprockets 90,92 so that when corrugator motor (not shown) is energized each of the pulling wheels 36,38 rotates at the same speed to support and convey tubing 14 through the machine 10. Gear 98 on the lower wheel 38 meshes with gear 99 on the upper wheel so that the wheels rotate in unison.

The pulling wheels shown accommodate tubing having a fixed diameter. When different diameter tubing is processed, the machine 10 is easily modified by simply changing the pulling wheels and blade mandrels.

A table or carriage 100 is positioned on the bed portion 18 of the framework 16 between the entrance and exit pulling wheel pairs. The carriage supports the cutting structure that provides the slotted openings in the tubing 14 as it travels through the machine 10. The carriage 100 reciprocates in the direction of tube travel so that the actual cutting operation occurs as the tubing is moving through the machine, as explained more fully below.

The base of the carriage 100 includes wheels 102 that ride on tracks 104 secured to the bed portion 18 of the framework 16. An air cylinder 106 connected between the carriage 100 and the framework 16 provides the motivating force for reciprocating the carriage. The piston shaft end 108 of the cylinder 106 is connected to a bracket 110 on the carriage while the cylinder end 112 is secured to cross-piece 114 of framework 16. Also, as explained more fully below, the motivating structure for the carriage 100 includes a catcher cylinder 116 which reacts between the cross-piece 114 and the carriage 100 at the start of the forward movement of the carriage. The catcher cylinder 116 provides an added push to the carriage to get it up to the speed of the tubing in short order at the start of a cutting sequence.

As explained above, the carriage 100 carries the individual cutter subassemblies that provide the slotted openings 12 in the tubing 14. In this regard, the carriage 100 includes annular upright end frames 120,122, and three horizontal shafts 124,126,128 are journaled between these upright frames. The horizontal shafts 124,126,128 are interconnected by a linkage arrangement generally including bell cranks and turn buckle links. As shown best in FIG. 1, horizontal shaft 124 is connected to shaft 126 by a bell crank 130 and a turn buckle link 132. A second bell crank 134 connects the opposite end of the turn buckle 132 to the horizontal shaft 126. Shaft 126 connects with horizontal shaft 128 via the bell crank 134, a second turn buckle link 136 and a bar link 138. The bell cranks 130 and 134 and the bar link 138 are fixed to their respective shafts 124,126,128 so that movement of the linkage arrangement causes those shafts to rotate. An air cylinder 140 completes the linkage arrangement and the piston 142 thereof is connected to the bell crank 130. As explained more fully below, when the air cylinder 140 is motivated the various bell cranks and turn buckle links cause the horizontal shafts 124,126,128 to rotate. As shown best in FIG. 5, this network of linkages is located adjacent the upright end frame 120 of the carriage.

Each horizontal shaft 124,126,128 carries a cutter subassembly 150. Subassembly 150 is connected to shaft 124 by a pair of opposite arms 152,154 fixed to the shaft 124 at the extremes thereof, and the outer free ends of the arms 152, 154 are interconnected by a bar 156. A rotatable horizontal shaft 158 is journaled near the free end of the arms 152,154, and the various cutter blades are secured to this horizontal shaft, as explained more fully below.

Figure 1:
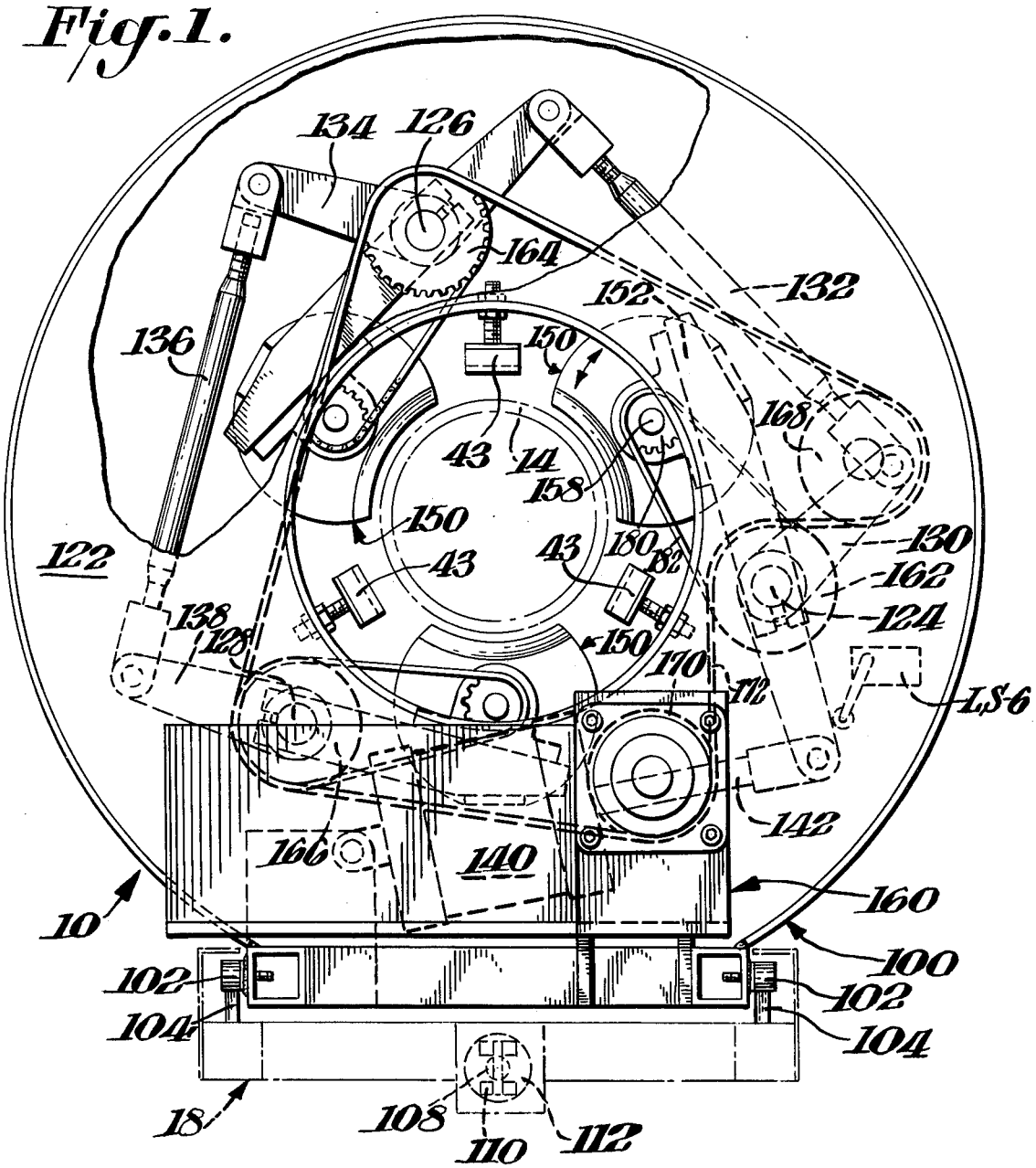
FIG. 1 is an end elevational view of the exit end of the cutter carriage of a tube slotting machine, according to the present invention, with portions broken away to show interior details.
Figure 2:
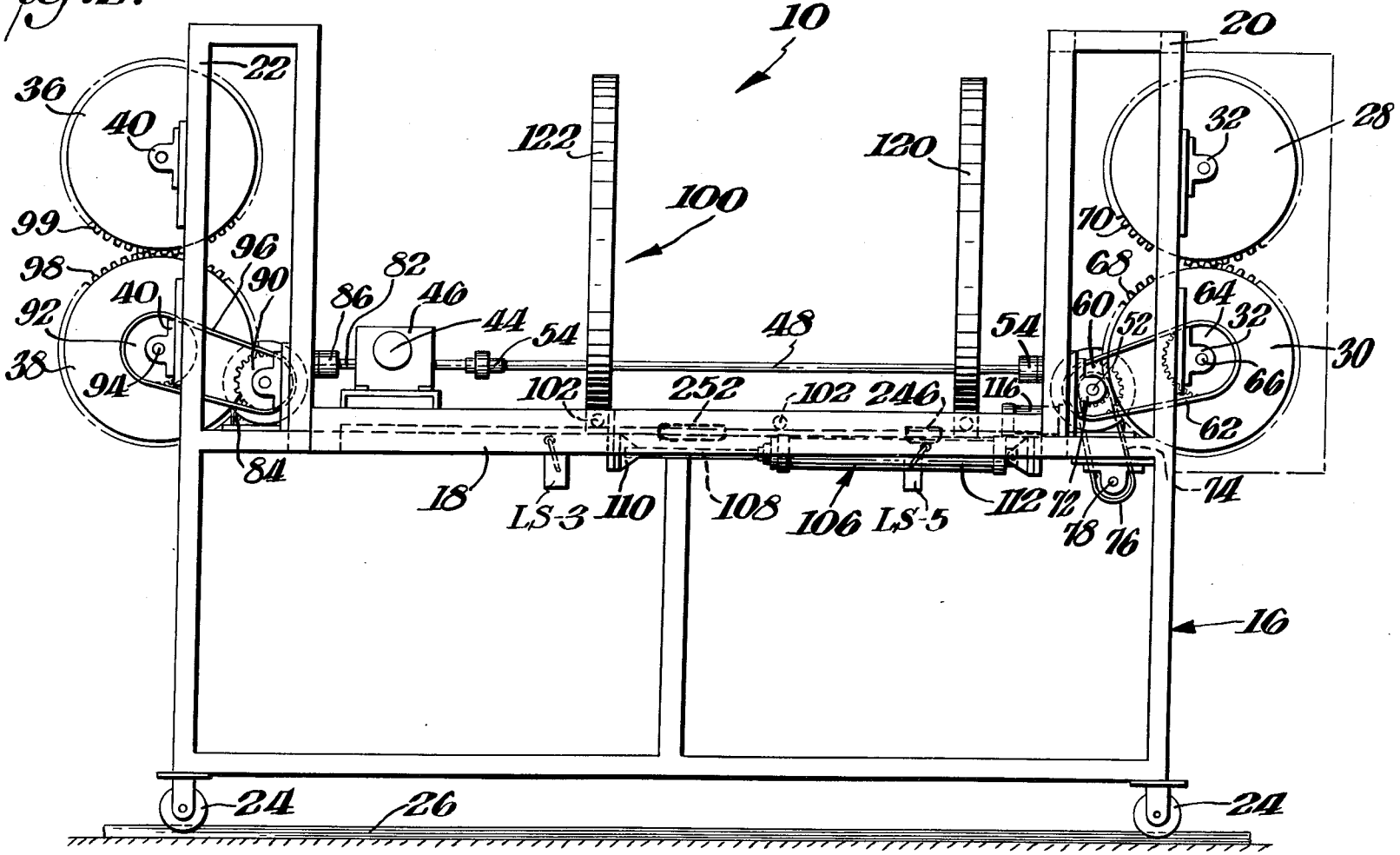
FIG. 2 is a side elevational view of the tube slotting machine shown in FIG. 1 with only an outline of the cutter carriage.

As best shown in FIG. 1, rotation of the stationary horizontal shaft 124 via activation of the air cylinder 140 causes the bracket arms 152,154 to move toward and away from the path of travel of the tubing 14. As explained more fully below, rotation of the horizontal shaft 124 causes the cutter blades associated with shaft 158 to engage the corrugated tubing 14. When such engagement takes place the shaft 158 is rotated to accomplish the tube slotting operation, and such rotation is carried out by a chain and sprocket drive powered by a reversing air motor 160.

Each of the fixed horizontal shafts 124,126,128 includes a sprocket 162,164,166, respectively, mounted on the horizontal shafts but free rotating relative thereto. Additionally, an idler sprocket 168 is journaled to the upright end frame 122 and a drive sprocket 170 is secured to the shaft of the air motor 160. An endless chain 172 is trained around these sprockets, as shown best in FIG. 1.

Each horizontal shaft 124,126,128 also carries a free rotating second sprocket 174,176,178, respectively, connected for movement with the first sprockets 162,164,166. Also, each movable shaft 158 has a sprocket 180 keyed thereto and a separate chain 182 interconnects each of the second sprockets 174,176,178 with its associated sprocket 180 on the shaft 158 of the individual cutting subassemblies 150. Movement of the chain 172 caused by motivation of the air motor 160 ultimately causes the shaft 158 of each cutting subassembly to rotate.

FIGS. 6 and 7 illustrate features of one of the three cutting subassemblies 150. Each shaft 158 carries six cutting heads 200 and each cutting head comprises a primary cutter blade 202 keyed to the shaft 158 at 204 for movement with the shaft. Each cutting head 200 further includes a pair of secondary blades 206,208 free rotating with respect to the shaft 158. The secondary blades include concavely curved portions 210 that complement the curvature of the tubing 14 and these portions are dimensioned to enter into the corrugations of the tubing. The secondary blades 206,208 of each pair are somewhat spaced apart and the primary blade 202 of each cutting head is located therebetween. Sufficient clearance exists so that the primary blade is free to rotate relative to the secondary blades when the 158 rotates. Suitable spacers 212 are provided between the six cutting heads 200, and fasteners 214 secure each pair of secondary blades together with a space therebetween for the primary blade. Also, the secondary blade pairs are interconnected by the bar 156 of each cutting subassembly 150 which fits into notches 216 in the secondary blades.

Each primary cutter blade has a curved cutting edge 220 on each side thereof spaced apart by the thickness of the primary blade. The cutting edges 220 are formed by cutout portions 222 in each primary cutter blade, and these cutout portions 222 vary in size from one primary blade to the next, for the reasons noted below. Each primary cutter blade has a knife-like edge 224 that penetrates the tubing 14 upon rotation of the shaft 158. During the cutting stroke of the primary cutter blade, each cutting edge 220 sweeps across cutting edges 226 and 228 on the secondary blade pair associated therewith to thereby cut a slivered portion or chip 230 from the tube to provide a transverse slotted opening 12 therein. One of the cutting edges 220 of the primary cutter blade sweeps across cutting edge 226 of secondary blade 206 while the other cutting edge 220 of blade 202 sweeps across cutting edge 228 of secondary blade 208. Ultimately, the chips 230 are pushed in the space between the spaced apart secondary blades and out through the opening 232 therein. The curved cutting edges 220 of the primary cutter blades and the blade material therebetween function as a plow which cuts and lifts the chips 230 away from the tubing 14. This feature leaves the interior of the tubing free of chips.

The cutout portions 222 of the primary cutter blades are designed so that only two blades of each cutting subassembly 150 are cutting the tube at any one time. As shown in FIG. 7, the actual cutting stroke is approximately 60° of rotation of the primary cutter blade. With the cutout arrangement of FIGS. *7a–7f*, only two primary cutter blades are actually cutting at any one time.

The second and third cutting subassemblies are identical to the assembly described above in conjunction with FIGS. 6, 7 and *7a–7f*. However, the above noted idler sprocket 168 functions to reverse the direction of rotation of the sprockets associated with horizontal shaft 124 in comparison to the direction of rotation of the sprockets associated with horizontal shafts 126 and 128. Hence, the cutting direction of two of the cutting subassemblies is the same while the cutting direction of the third subassembly is opposite. This feature eliminates or substantially minimizes the tendency of the tube to rotate about its axis during the cutting operation.

Figure 3:
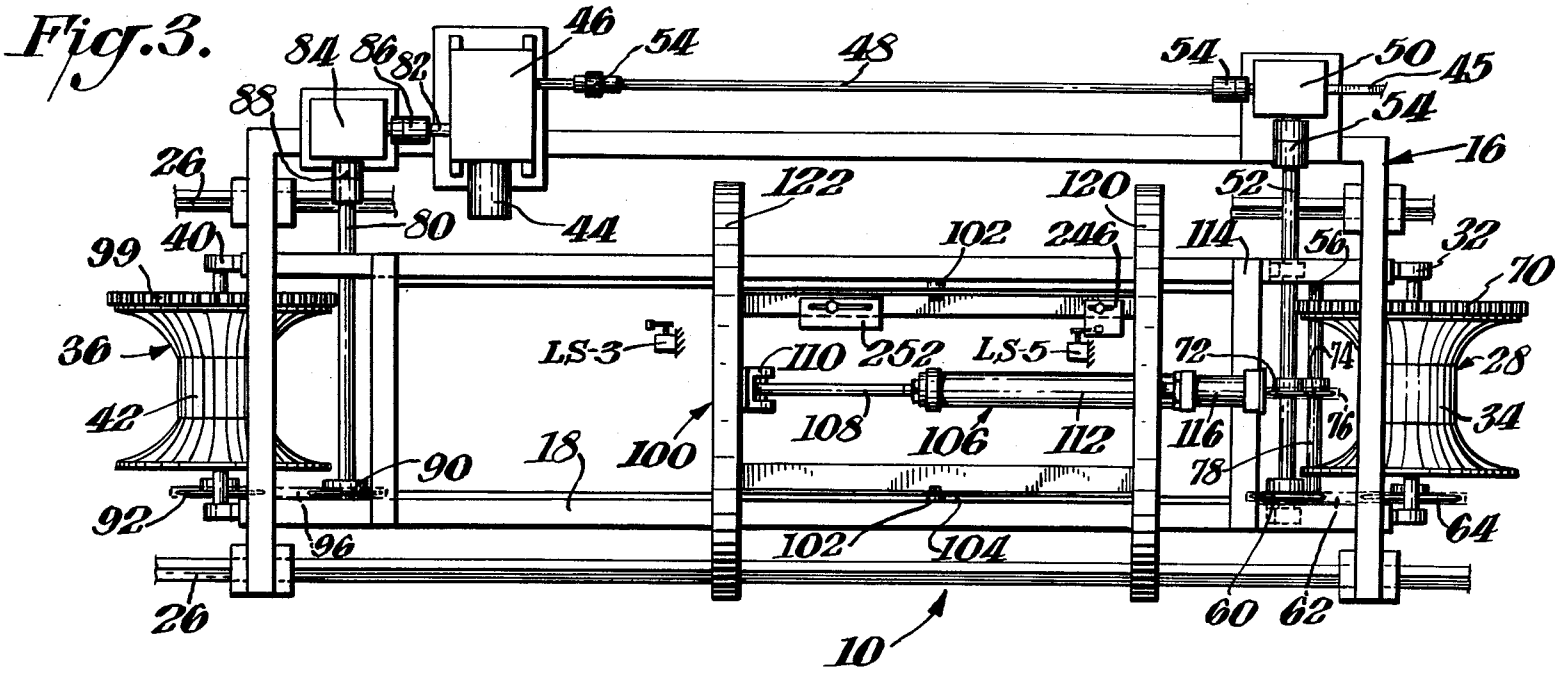
FIG. 3 is a top plan view of the tube slotting machine shown in FIGS. 1 and 2 with portions of the cutter carriage removed to illustrate details of the drive train for the overall machine.
Figure 4:
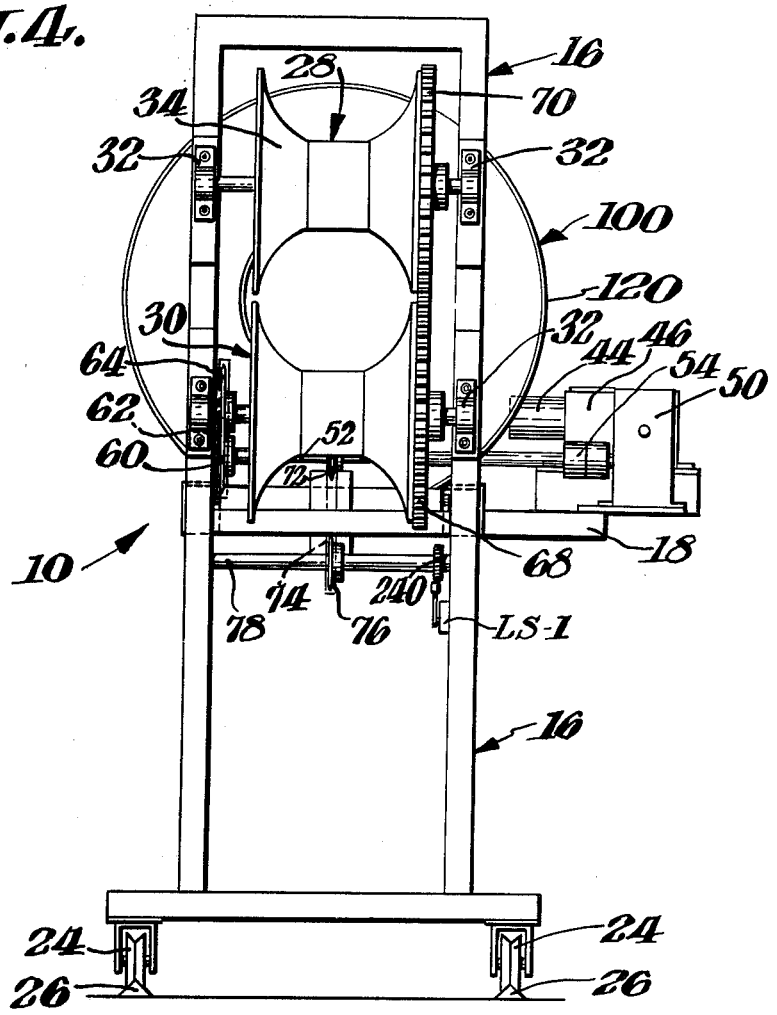
FIG. 4 is an end elevational view of the entrance end of the tube slotting machine shown in FIGS. 1–3.

Turning now to the machine control, an indexing programmer 240 is secured to shaft 78 journaled to the framework 16 for rotation with the drive train for the pulling wheels 28,30 at the entrance end of the machine 10. Referring to the diagrams of FIGS 8 and 9, the indexing programmer 240 trips switch LS-1 to close the circuit of FIG. 9 every time the corrugated tubing 14 travels one foot. Switch LS-1 closing causes the control relay CR to become energized which closes control relay CR-1 which holds the circuit closed. Switch LS-3 shown in FIG. 3 is wired normally closed, and this particular circuit actuates solenoid Sol-1 of FIG. 8. When solenoid Sol-1 is energized, a four-way valve 242 is shifted so that the flow of air to the rod end of the carriage cylinder 106 is shut off and a dump valve 244 is opened exhausting air to the atmosphere. This causes air in the head end of the carriage cylinder 106 (which is constantly pressurized) to extend the piston rod 108 and move the carriage 100 in the direction of tube travel via the wheels 102 and tracks 104. The catcher cylinder 116 is constantly pressurized at its head end so that it helps to accelerate the carriage 100 up to the tube speed.

The energizing of the control relay CR also causes control relay CR-2 to close. Switch LS-5, shown best in FIG. 3, is wired normally closed and is held open by a cam 246 secured to the framework of the carriage 100. The cam 246 holds switch LS-5 open until the carriage 100 commences movement in the direction of tube travel. Also, the cam 246 is adjustable so that closing of the switch can be adjusted to occur when the carriage speed and tube speed are equal.

Solenoid Sol-2 is energized when switch LS-5 closes. Four-way valve 248 is shifted which causes the air cylinder 140 to rotate the three cutting subassemblies 150 into engagement with the tubing 14. The linkage arrangement of bell cranks 130,134, turn buckle links 132,136 and bar link 138 transmit the movement of the air cylinder 140 to the cutting subassemblies. Ultimately, the curve portions 210 of the secondary blades engage, lock and clamp onto the tubing 14. When this occurs the carriage 100 and the tube are locked together for continued movement.

When the piston 142 of the air cylinder 140 extends switch LS-6 is closed by the bell crank 130, thereby energizing solenoid Sol-3. Energizing solenoid Sol-3 causes the air motor 160 to rotate and such rotation is transmitted to each primary cutter blade via the chain and sprocket transmission which interconnects the air motor with the three shafts 158 to which the primary cutter blades are keyed. The solenoid Sol-3 operates the four-way valve 250 to energize the air motor 160.

When the carriage reaches the end of its forward movement, switch LS-3, shown best in FIG. 3, is opened by an adjustable cam 252 secured to the framework of the carriage 100. All of the solenoids are then de-energized, and all functions return to their original position. The piston 142 of the air cylinder is retracted which moves the individual cutting subassemblies away from the tubing, the air motor 160 is reversed to return the primary cutter blades to their starting position, and air is admitted to the rod end of carriage cylinder 106 which causes the carriage to return to its starting position. The cycle is then repeated. Three slotted openings 12 are provided in every other corrugated valley.

FIGS. 10–22 illustrate another tube slotting machine 300 for cutting a series of transverse slotted openings in flexible corrugated tubing 304. Corrugated drainage tubing is formed as described above in connection with the description of slotting machine 10, and the machine 300 may be a replacement therefor or used as an alternative thereto.

In the embodiment of the invention illustrated in FIGS. 10–22, each of a plurality of primary cutter blades sweeps across its associated secondary blade pair to cut a slivered portion or chip from the tubing 304 to thereby provide the transverse slotted openings 302. The secondary blade pairs are positioned next to the exterior of the tubing 304 and the primary cutter blades reciprocate so that each primary blade penetrates the tubing and sweeps across its associated secondary blade pair to cut the slotted openings 302.

Similar to slotting machine 10, each primary cutter blade of the machine 300 has two sharp edges spaced apart by the thickness of the blade while each secondary blade has a single sharp edge. During the cutting operation, the two sharp edges of a primary cutter blade sweep across the sharp edges of the secondary blade pair with the tubing 304 therebetween. The shearing action between the sharp edges of these blades cuts a clean sliver or chip from the tubing to thereby produce a slotting opening 302 free of roughened edges.

As shown best in FIGS. 10–14, the tube slotting machine 300 comprises a main framework 306 which supports the various components of the overall machine. Generally the framework 306 includes a bed portion 308 with spaced apart upright portions 310,312 at the ends thereof. Upright portion 310 forms the entrance end of the machine while portion 312 forms the exit end of the machine. Wheels 314 are journaled to the underside of the framework 306 and these wheels cooperate with rails 316 on the ground for positioning the machine 300 at various locations. As shown in the drawing, the overall composite of the framework 306 includes other structural elements that impart the desired structural strength thereto.

The machine 300 has tube supporting and conveying structure for guiding the tubing 304 through the machine. This structure includes a first pair of pulling wheels 318,320 mounted for rotation and capable of moving toward and away from one another. The exterior of each of the pulling wheels includes teeth 322 constructed and arranged to mesh with the corrugations in the tubing 304. Corrugated tubing is delivered between the nip of the pulling wheels 318,320, and rotation thereof causes the tubing to move out of the machine via the meshing engagement of the pulling wheel teeth 322 and the tube corrugations. As shown best in FIGS. 11 and 12, the axis of rotation of each of the pulling wheels 318,320 is disposed at 45° from the vertical. Hence, the pulling wheels 318,320 are offset 45° to one side of the tubing 304.

The tube supporting and conveying structure also includes a second pair of pulling wheels 324,326 mounted for rotation and capable of moving toward and away from one another. The exterior surface of each pulling wheel 324,326 includes teeth 328 that meshingly engage the corrugated tube to push it into the machine 300 when the wheels rotate. The axis of rotation of the second pair of pulling wheels are each positioned at an angle of 45° from the vertical. But unlike the pulling wheels 318,320, the wheels 324,326 are located on opposite sides of the tubing from the wheels 318,320. Hence, as shown in FIG. 11, the axis of the exit pair of pulling wheels are located along the 45°–225° line, while the axis of the entrance pair of pulling wheels are disposed along the 135°–315° line. The pulling wheels 318,320 at the exit end pull the tubing 304 out of the machine while pulling wheels 324,326 at the entrance end pull the tubing into the machine. Tube guides 330 are also provided.

As explained above, each pair of pulling wheels is rotatably mounted and the individual wheels are capable of moving toward and away from one another. Since the mounting mechanism for each pair of pulling wheels is the same, only one such mechanism is described, it being understood the other is identical thereto in all major respects. As shown in FIG. 12, a pair of spaced apart parallel shafts 332,334 are journaled to the upright portion 310 of the framework 306. Suitable journal blocks 336 are provided for this purpose. Shaft 332 carries a pair of spaced mounting arms 338 extending therefrom and free rotating relative thereto while the second shaft 334 carries a similar pair of arms 340 relative thereto. The pulling wheels 324,326 are journaled to the free ends of the mounting arms 338,340, as shown best in FIGS. 13 and 14, and as explained more fully below.

Cooperating gear segments 342,344 are mounted to the shafts 332,334 for free rotation relative thereto. Gear segment 342 is secured to one of the mounting arms 338 for movement therewith and the other segment 334 is secured to one of the arms 340. Hence, gear segment 342 is connected for movement with mounting arm 338 while gear segment 344 is connected for movement with mounting arm 340. As can readily be understood from FIGS. 13 and 14, rotation of the gear segments causes the pulling wheels to move toward and away from one another in equal increments from the longitudinal axis of tube travel through the machine. This enables initial threading of the tubing through the machine and also enables the pulling wheels to accommodate different diameter tubing. An air cylinder 345 is connected between one of the arms 338 and one of the arms 340 for moving the wheels 318,320 toward and away from one another.

The pulling wheels 318,320 are drivingly connected to the main drive shaft 346 for the machine 300 which in turn is connected to the corrugator. Shaft 346 carries a sprocket 348 which is connected to sprocket 350 by chain 352. The sprocket 350 is connected to a worm gear box 354 which in turn is connected to the shaft 334. Shaft 332 is connected to rotate at the same speed as shaft 334 via a worm gear box 356, sprocket 358, chain 360, and a second sprocket connected for rotation with the sprocket 350.

The pulling wheels 324 and 326 are motivated in the same manner as described above. The drive shaft 346 also serves to rotate these pulling wheels via a similar chain and sprocket arrangement.

Continuing, the shaft 332 has a sprocket 362 fixed thereto and this sprocket is connected by chain 364 to a sprocket 366 secured to the assembly for the pulling wheel 318. Similarly, the shaft 334 carries a sprocket 368 fixed thereto and connected by a chain 370 to a sprocket 372 connected to the assembly for the pulling wheel 320. In summary, rotation of the shafts 332,334 cause the pulling wheels 318,320 to rotate, and movement of the meshing gear segments 342,344 cause the pulling wheels to move toward and away from one another.

FIG. 16 illustrates one of two pairs of cutting subassemblies 400 associated with the slotting machine 300. Each cutter subassembly cooperates with one of the pulling wheels, and the cutting assemblies of each wheel pair are mounted on the same axis as the wheels for movement toward and away from one another just as the wheels move toward and away from one another upon manipulation of the gear segments 342,344. Only one cutting subassembly is described, it being understood that the other three subassemblies are identical in all major respects.

Each cutting subassembly 400 includes a plurality of primary cutter blades 402 mounted for reciprocal movement in a direction transverse to the direction of tube travel through the slotting machine. Each primary cutter blade 402 is associated with a pair of secondary blades 404,406 carried by the pulling wheel 318 and forming a portion of the periphery thereof. The secondary blades include concavely curved portions 408 that complement the curvature of the tubing 304 and these portions are dimensioned to enter into the corrugations of the tubing. The secondary blade pairs together with the teeth 320 comprise the periphery of the pulling wheel 318. The secondary blades 404,408 of each pair are somewhat spaced apart and the primary blade 402 associated therewith is located therebetween. Sufficient clearance exists so that the primary blade is free to reciprocate relative to the secondary blades during the cutting operation, as explained more fully below.

Each primary cutter 402 has a curved cutting edge 410 on each side thereof spaced apart by the thickness of the primary blade. Additionally, each primary cutter blade has a knife-like front edge 412 that penetrates the tubing 304 upon reciprocation of the primary cutter blade. During the cutting stroke of the primary cutter blade, each side cutting edge 410 sweeps across curved cutting edges 414 and 416 on the secondary blade pair associated therewith to thereby cut a slivered portion or chip 418 from the tube to provide a transverse slotted opening 302 therein. One of the cutting edges 410 of the primary cutter blade sweeps across cutting edge 414 of secondary blade 404 while the other cutting edge 410 of blade 402 sweeps across cutting edge 416 of secondary blade 406. The curved cutting edges 410 of the primary cutter blade and the blade material therebetween function as a plow which cuts and lifts the chips 418 away from the tubing. This feature leaves the interior of the tubing free of chips. Ultimately, the chips fall into chip pans 420 removably secured to the framework 306 directly under the cutting subassemblies 400.

As shown best in FIGS. 16 and 20, the pulling wheel of each cutting subassembly 400 includes a plurality of passageways parallel to and equally spaced from the axis of rotation of the pulling wheel. Each passageway has a blade holder 432 associated therewith and each blade holder has a primary cutter blade 402 connected thereto at 433. As shown best in FIG. 16, additional support structure 434,436 is provided for each primary blade holder near the ends of the holder. The blade holder supports 434,436 are lined with bushings 438 so that the holders freely reciprocate during the cutting sequence.

The right end of each blade holder 432, as viewed in FIG. 16, has a rotatable cam follower 440 while the opposite end of each holder 432 includes biasing structure in the form of a coil spring 442 which urges the blade holder to the right, as viewed in FIG. 16. Each biasing structure is located in a housing 444.

The cam followers 440 connected to each primary blade holder 432 ride on a stationary cam track 446 designed so that upon each revolution of the pulling wheel each primary blade holder 432 is urged against the coil spring 442 and then released at the appropriate time whereby the primary blade in cooperation with its associated secondary blade pair slices a chip from the tubing to provide a transverse slotted opening therein. Each cutting subassembly 400 carries twelve primary cutter blades 402 together with the blade holders 432 therefor.

The cam track 446 together with the development thereof is shown in FIGS. 17–19 with the twelve positions noted on the track. After cutting position 1 the rotatable follower 440 rides along the cam track 446 until the follower returns to position 12 just prior to cutting stroke position 1. At position 12 the blade holder has biased the coil spring 442 its maximum amount. Continued rotation of the pulling wheel then causes the cam follower to leave the track so that the blade holder is free to move the primary blade through and across the tube to cut a chip therefrom. The stationary cam track includes an extension piece 448 at the end thereof just prior to the cutting stroke. This extension takes the pressure off of the rotatable follower 440 and enables the side portions 450 of the bracket 452 for the follower to slide on the extensions until the holder is released at position 1 for the cutting stroke.

A bumper or shock absorber 460 is provided to absorb the shock of the primary blade holder 432 immediately following the cutting action. Also, as shown best in FIG. 15, the coil spring 442 is located in its housing 444 so that no biasing force is applied to the blade holder at the end of its cutting stroke. The shock absorber 460 also functions to start the blade holder on its return stroke immediately following the cutting operation. Thereafter, the cooperation between the cam track 446 and cam follower 440 returns the primary cutter blade to its cutting position once for each revolution of the pulling wheels.

In operation, the tube slotting machine 300 functions to provide alotted openings 302 in corrugated tubing 304. The main drive shaft 346 is motivated by a suitable prime mover (not shown), and the various transmission components between that drive and the pulling wheel sprockets 366,372 functions to rotate the pulling wheels 318,320. The pulling wheels 324,326 are similarly rotated. Such rotation causes the corrugated tubing 304 to travel through the machine via the meshing engagement between the teeth 322,328 on the periphery of the pulling wheels and the corrugations of the tubing. The secondary blade pairs also located on the periphery of the pulling wheels mesh with the corrugations.

As the pulling wheels rotate, the primary cutter blade holders 432 associated therewith also rotate. In addition, the blade holders reciprocate in a transverse direction via the interaction between the cam followers 440 and the stationary cam track 446. As explained above, this motion loads and unloads each blade holder once for each revolution of the pulling wheel.

Each primary blade holder 432 is instantaneously unloaded during the cutting stroke whereby the primary cutter blade 402 interacts with its associated secondary blades 404,406 to slice a chip 418 from the tubing in the manner explained above. Continued rotation of the pulling wheel and its associated primary blade holders functions to again bias the coil spring 442 its maximum amount during the return stroke of the blade holders. Thereafter the sequence is repeated for each revolution of the pulling wheels.

Two transverse slotted openings 302 are cut into the tubing 304 at the same time by the cutting subassemblies 400 associated with the entrance pulling wheels 318,320. The cutting direction of the primary cutter blades performing the operation are the same and this feature eliminates any tendency of the tubing to rotate.

As shown best in FIG. 16, the cuts in the tubing are 180° apart. Similarly, the cutting subassemblies 400 associated with the exit pulling wheels 324,326 cut two slotted openings 303 into the tubing 304, 180° apart. The cutting stroke direction is the same and this eliminates the tendency of the tubing to rotate, as explained above. Ultimately the tubing exits the machine 300 with four rows of slotted openings 302 with the rows 90° apart.

What is claimed:

1. A tube slotting machine for cutting a series of transverse slotted openings in flexible corrugated tubing comprising a main framework, tube supporting and conveying means connected to the framework for guiding the tubing through the machine, and cutting means adapted to engage the tubing as it travels through the machine and to cut transverse slotted openings therein, the cutting means including a plurality of primary cutter blades, an equal number of spaced apart secondary blade pairs, the secondary blades of each secondary blade pair being slightly spaced apart with a primary blade located therebetween, each primary blade being mounted for sliding engagement with the secondary blades of its associated secondary blade pair, each of the secondary blades having a curved portion that complements the curvature of the tubing, means for positioning the curved secondary blade pairs next to the exterior of the tubing as it moves through the machine along its path of travel, and means for shifting the primary cutter blade across its associated secondary blade pair when that blade pair is next to the exterior of the tubing whereby the primary blade penetrates the tubing and sweeps across its associated secondary blade pair in sliding engagement therewith to thereby cut a slivered portion from the tubing to provide a transverse slotted opening therein.

2. A tube slotting machine as in claim 1 wherein each primary cutter blade has a cutting stroke and a return stroke, and wherein the means for shifting the primary cutter blades is connected to rotate those blades through their cutting and return strokes.

3. A tube slotting machine as in claim 1 wherein each primary cutter blade has a cutting stroke and a return stroke, and wherein the means for shifting the primary cutter blades is connected to reciprocate those blades through their cutting and return strokes.

4. A tube slotting machine as in claim 1 wherein the cutting means includes a carriage with means connecting the primary blades and the secondary blade pairs thereto, and motivating means connected to reciprocate the carriage over a portion of the path of tube travel at a speed equal to the speed of travel of the tubing during the cutting thereof.

5. A tube slotting machine as in claim 4 wherein the motivating means includes an air cylinder connected between the framework of the machine and the carriage, and a second air cylinder between the framework and the carriage to assist in accelerating the carriage at the start of its movement in the direction of travel of the tubing.

6. A tube slotting machine as in claim 4 including tracks on the framework of the machine and wheels on the carriage constructed and arranged to ride on the tracks.

7. A tube slotting machine as in claim 4 wherein the cutting means includes three cutter subassemblies arranged around the tubing and approximately 120° apart, each cutter subassembly including a plurality of primary cutter blades and an equal number of secondary blade pairs.

8. A tube slotting machine as in claim 7 wherein each primary cutter blade has a cutting stroke and a return stroke, and wherein the means for shifting the primary cutter blades is connected to rotate those blades through their cutting and return strokes.

9. A tube slotting machine as in claim 8 including a chain and sprocket drive interconecting the primary cutter blades of each cutter subassembly.

10. A tube slotting machine as in claim 9 wherein the primary cutter blades of two of the cutter subassemblies rotate in the same direction while the primary cutter blades of the third subassembly rotate in the opposite direction.

11. A tube slotting machine as in claim 1 wherein the means for positioning the curved secondary blades next to the exterior of the tubing comprises a pivotally mounted frame with the primary and secondary cutter blades mounted thereon at a position spaced from the pivotal connection, and motivating means for shifting the cutting blades into and out of engagement with the tubing.

12. A tube slotting machine as in claim 1 wherein the tube supporting and conveying means includes a pair of first pulling wheels journaled to the framework of the machine and a pair of second pulling wheels journaled to the framework of the machine, each of the pulling wheels having peripheral teeth constructed and arranged to mesh with the corrugations of the tubing, and motivating means rotating the pulling wheels to move the tubing through the machine.

13. A tube slotting machine as in claim 12 wherein the pulling wheels of the first pulling wheel pair are disposed one above the other, and the pulling wheels of the second pulling wheel pair are also disposed one above the other.

14. A tube slotting machine as in claim 12 wherein the pulling wheels of the first pulling wheel pair are offset about 45° to one side of the path of tube travel, and the pulling wheels of the second pulling wheel pair are offset about 45° to the other side of the path of tube travel.

15. A tube slotting machine as in claim 12 wherein the journaled connection of the pulling wheel pairs to the framework of the machine includes means to move the wheels of each pair toward and away from one another to thereby vary the distance between the wheels to accommodate tubing of different diameter.

16. A tube slotting machine as in claim 12 wherein the primary cutter blades are reciprocally mounted on each of the pulling wheels and the secondary cutter blade pairs are fixed on the exterior of the wheels.

17. A tube slotting machine as in claim 1 wherein the primary cutter blades are reciprocally mounted adjacent the path of tube travel for transverse movement relative thereto.

18. A tube slotting machine as in claim 17 wherein the cutting means includes a pair of opposite cutter subassemblies, a rotatable mounting for each subassembly adapted to rotate about an axis transverse to the path of tube travel, and each subassembly including a plurality of primary cutter blades mounted for movement along a path parallel to the axis of the subassembly mounting and equally spaced therefrom.

19. A tube slotting machine as in claim 18 wherein the cutting means includes two longitudinally spaced apart pairs of opposite cutter subassemblies.

20. A tube slotting machine as in claim 17 wherein the means for shifting the primary cutter blades across their associated secondary blade pairs includes biasing means.

21. A tube slotting machine as in claim 20 including cam means for loading the primary cutter blades against the biasing means prior to the cutting stroke of the primary blades.

22. A tube slotting machine as in claim 1 wherein the means for positioning the curved secondary blade pairs next to the exterior of the tubing includes wheels rotatably mounted adjacent the path of tube travel, the wheels including the secondary blade pairs fixed to the exterior thereof for meshing engagement with the tubing.

* * * * *